US007547834B2

(12) United States Patent
Minakuchi

(10) Patent No.: US 7,547,834 B2
(45) Date of Patent: Jun. 16, 2009

(54) STRING REPLACEMENT ASSISTANCE APPARATUS

(75) Inventor: Kiyoshi Minakuchi, Hamamatsu (JP)

(73) Assignee: Yamaha Corporation, Shizuoka (JP)

( * ) Notice: Subject to any disclaimer, the term of this patent is extended or adjusted under 35 U.S.C. 154(b) by 65 days.

(21) Appl. No.: 11/154,133

(22) Filed: Jun. 16, 2005

(65) Prior Publication Data

US 2006/0005687 A1 Jan. 12, 2006

(30) Foreign Application Priority Data

Jul. 12, 2004 (JP) ..... 2004-204201

(51) Int. Cl.
*G10D 3/00* (2006.01)

(52) U.S. Cl. ..... 84/313; 84/290

(58) Field of Classification Search ..... 84/313, 84/297 R, 298, 299, 312 R, 267, 290, 323; D17/21

See application file for complete search history.

(56) References Cited

U.S. PATENT DOCUMENTS 4,697,493 A * 10/1987 Ralston ..... 84/313
5,010,803 A * 4/1991 Donnell ..... 84/743
5,551,329 A * 9/1996 Iovane ..... 84/313
5,649,504 A * 7/1997 Culp ..... 119/795
5,847,298 A * 12/1998 Adams ..... 84/314 R
6,420,639 B1 * 7/2002 Sherlock ..... 84/313
6,745,950 B1 * 6/2004 Longo ..... 239/44

* cited by examiner

*Primary Examiner*—Jeffrey Donels
*Assistant Examiner*—Jianchun Qin
(74) *Attorney, Agent, or Firm*—William L. Androlia; H. Henry Koda

(57) ABSTRACT

A string replacement assistance apparatus is used when the strings of a stringed instrument equipped with a tremolo unit are replaced. The tremolo unit makes a pivotal movement in arm-up and arm-down directions by an operation of a tremolo arm connected thereto. The string replacement assistance apparatus includes a base section which is to be put on the body of the stringed instrument and a holding section which is elongated from the base section and holds the tremolo arm to prevent the tremolo unit from the pivotal movement.

13 Claims, 7 Drawing Sheets

STRING REPLACEMENT ASSISTANCE APPARATUS

BACKGROUND OF THE INVENTION

1. Field of the Invention

The present invention relates to a string replacement assistance apparatus used when replacing strings in a stringed instrument. More particularly, the present invention relates to an assistance apparatus for facilitating the replacement of strings in a stringed instrument equipped with a tremolo unit.

Priority is claimed on Japanese Patent Application No. 2004-204201, filed Jul. 12, 2004, the content of which is incorporated herein by reference.

2. Description of Related Art

A tremolo unit has been used in a stringed instrument, such as an electric guitar. The tremolo unit supports one ends of strings to obtain a tremolo effect in which the musical interval is minutely increased and decreased by repeatedly changing the tension of the strings in rapid cycles. The structure of such tremolo unit known in the art is shown in FIGS. 9 to 11.

In FIGS. 9 and 10, a tremolo unit 50 is provided on a front surface (an upper surface in FIG. 10) of a body 52 of an electric guitar 51. The tremolo unit 50 includes a bridge base 54 which is pivotally supported by a pair of fulcrum screws or posts 53 on the body 52. The bridge base 54 is provided with a plurality of bridge saddles 56 on its front surface, which secure one end (right-side end in FIG. 10) of associated one of strings 55. An elongated portion 57 is formed on a rear surface (a lower surface in FIG. 10) of the bridge base 54 and located in a recess 52A formed on the body 52. A tension spring 58, such as a coil spring or the like, is connected between a lower edge of the elongated portion 57 and an inner wall of the body recess 52A to be arranged in parallel to the strings 55. The bridge base 54 is further provided with a tremolo arm 60 which is pivotally supported on the front surface of the body 52.

The bridge base 54 makes a pivotal movement around the fulcrum posts 53 in both an arm-up direction A1 and an arm-down direction A2 in FIG. 10 when the tremolo arm 60 is moved in a direction indicated by an arrow R in FIGS. 10 and 11. This pivotal movement of the bridge base 54 changes the tension of the strings to obtain a tremolo effect in which the musical interval is minutely increased and decreased. The tension F1 of the strings 55 when they are attached to the guitar 51 and the spring force F2 of the spring 58 are balanced with respect to a pivotal movement around the fulcrum post 53 so as to hold the bridge base at a position shown in FIG. 10.

The conventional tremolo unit 50 thus structure has the following problems when the strings 55 are replaced. That is, when the tension F1 of the strings 55 is weakened or lost during the replacement of the strings 55, the bridge base 54 takes a position inclined to a direction indicated by an arrow S in FIG. 11 compared with the position in which the strings 55 are attached with the respective tensions as shown in FIG. 10 due to the spring force F2 of the spring 58. Under this condition, one end of a new string is secured to the associated one of the bridge saddle 56 and the other end of the new string is wound up to a turning screw (not shown) on a head of the guitar 51 to apply an appropriate tension for the string. Since the bridge base 54 is inclined in the direction S, it is necessary to wind up the other end of the string to the turning screw many times. Thus, the replacement of the strings is troublesome and takes much time in the stringed instrument equipped with the conventional tremolo unit.

SUMMARY OF THE INVENTION

The present invention has been made in view of such problems. It is, therefore, an object of the present invention is to provide a string replacement assistance apparatus capable of facilitating the replacement of strings in a stringed instrument and reducing the time required to replace the strings.

According to the present invention, there is provided a string replacement assistance apparatus for a stringed instrument equipped with a tremolo unit on a body of the stringed instrument, in which the tremolo unit makes a pivotal movement in arm-up and arm-down directions by an operation of a tremolo arm connected thereto. The string replacement assistance apparatus has a base section which is to be put on the body of the stringed instrument and a holding section which is elongated from the base section and holds the tremolo arm to restrict the pivotal movement of the tremolo unit.

In the string replacement assistance apparatus, a distance between the base section and the holding section may preferably be adjustable.

Further, in the string replacement assistance apparatus, the holding section may have an opening to receive the tremolo arm, in which the opening may be able to turn its direction.

Furthermore, in the string replacement assistance apparatus, the base section may preferably be provided with a friction member on a surface facing the body of the stringed instrument.

Still further, in the string replacement assistance apparatus, the base section may include a plurality of contact portions contacting to the body of the stringed instrument.

DETAILED DESCRIPTION OF THE INVENTION

Figure 1:
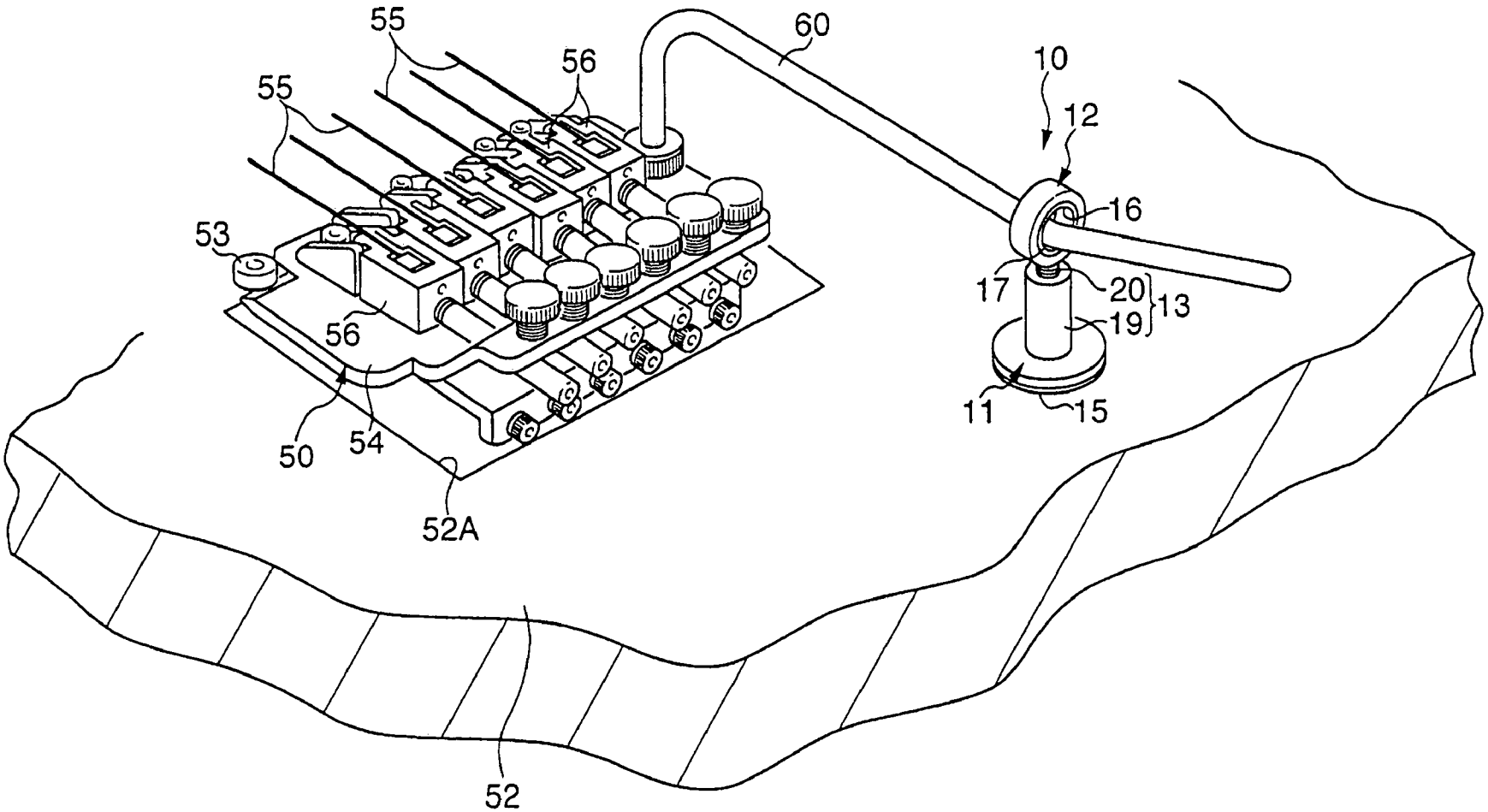
FIG. 1 is a perspective view showing a string replacement assistance apparatus according to a first embodiment of the present invention, which is in use for an electric guitar.

Preferred embodiments of the present invention will now be described with reference to the drawings.

In the preferred embodiments, a string replacement assistance apparatus is used for assisting a replacement of strings of an electric guitar as a stringed instrument. Since the structure of the electric guitar is basically the same as that described for the related art with reference to FIGS. 9 through 11, structural elements of the electric guitar similar to or the same as the related art embodiment bear the same reference numerals and explanations thereof may be omitted.

Further, in the preferred embodiment, "upper" and "lower" mean a front and a rear side of the guitar, respectively. That is, they mean upper and lower when the guitar is put or laid with its longitudinal direction horizontally and with the surface provided with strings up as shown in FIG. 1.

First Embodiment

FIG. 1 shows a string replacement assistance apparatus according to a first embodiment when it is used for replacing strings of an electric guitar 51. The string replacement assistance apparatus 10 is placed near a tremolo unit 50 on an upper surface of a guitar body 52 of an electric guitar 51 shown in FIG. 9. The string replacement assistance apparatus 10 includes a base section 11 which contacts the upper surface of the guitar body 52, a holding section 12 which is located at upper side of the base section 11 and holds a tremolo arm 60 of the tremolo unit 50, and a connecting section 13 which is located between the base section 11 and the holding section 13 to connect those sections 11 and 13.

The base section 11 is formed in a disk shape having a substantially circular shaped plate in a plane view. The base section 11 is attached with a friction member 15 on its lower surface which faces the guitar body 52. As the friction member 15, a rubber plate having a suitable flexibility is used in this embodiment, but it is not limited to the rubber plate. The friction member 15 is provided for preventing the string replacement assistance apparatus 10 from unnecessarily sliding on the upper surface of the guitar body 52 by its frictional force against the upper surface of the guitar body 52.

Figure 2:
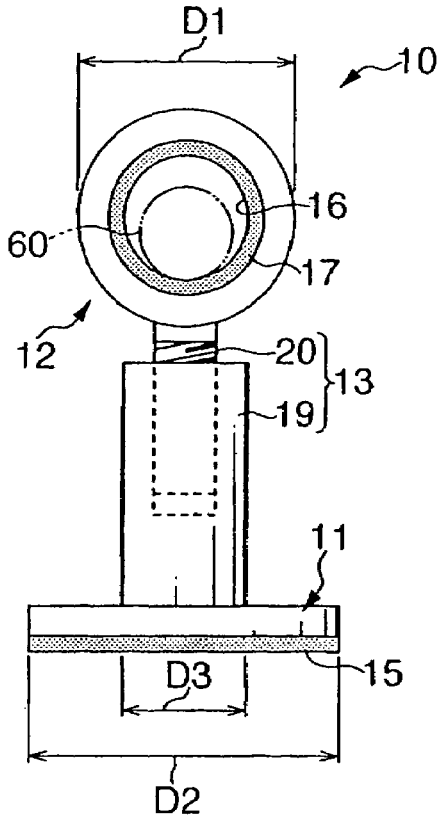
FIG. 2 is a front view showing the string replacement assistance apparatus according to the first embodiment of the present invention shown in FIG. 1.
Figure 3:
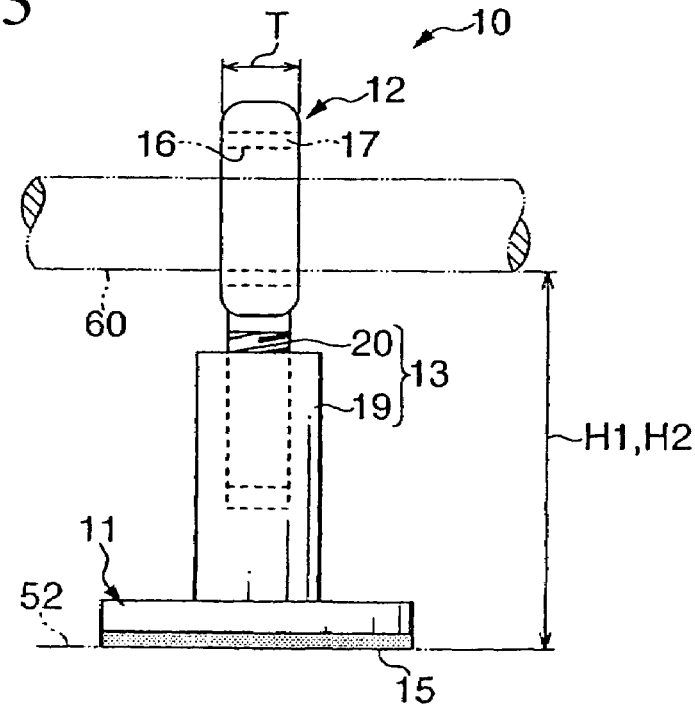
FIG. 3 is a side view showing the string replacement assistance apparatus according to the first embodiment of the present invention shown in FIG. 1.

The holding section 12 is formed in a cylindrical shape having an opening 16 having substantially a circular shape as also shown in FIGS. 2 and 3. The holding section 12 receives the tremolo arm 60 of the tremolo unit 50 through the opening 16 to hold the tremolo arm 60. An inner wall of the opening 16 is attached with a damping member or cushion 17 along the inner wall. As the damping member 17, a shock absorbing rubber having similar material to the friction member 15 is used in this embodiment.

Figure 4:
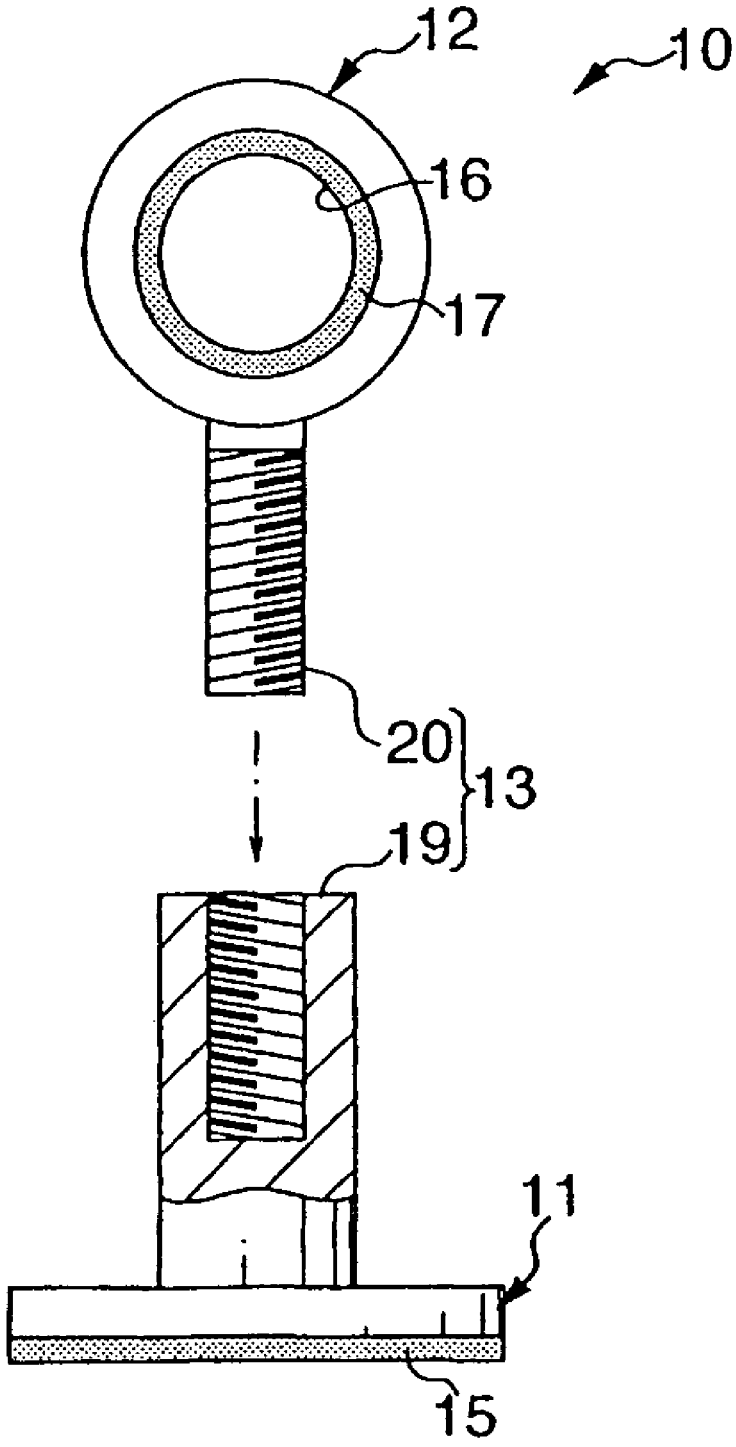
FIG. 4 is a front and partial cross-sectional view showing the string replacement assistance apparatus according to the first embodiment of the present invention shown in FIG. 2.

The connecting section 13 elongates to the upper side and has a screw structure to connect the base section 11 to the holding section 12. More specifically, as is best shown in FIG. 4, the connecting section 13 has a first screw portion 19 which is integrally formed with the upper surface of the base section 11 and has a cylindrical shape functioning as a female screw. The connecting section 13 also has a second screw portion 20 which is integrally formed with the lower portion of the holding section 12 and functions as a male screw to be screwed into the first screw portion 19. Thus, the height of the string replacement assistance apparatus 10, which is defined by a distance between the base section 11 and the holding section 12, is adjustable by tightening or loosing the second screw section 20 relative to the first screw section 19 so as to change the length of the connecting section 13. The direction of the opening 19 of the holding section 12 relative to the base section 11 is also adjustable in the same manner.

Referring back to FIGS. 2 and 3, an outer diameter D1 of the holding section 12 is smaller than an outer diameter D2 of the base section 11, but greater than an outer diameter D3 of the first screw section 19. That is, those diameters are determined to have the relationships of D3<D1<D2. Further, a thickness T of the holding section 12 (see FIG. 3) is smaller than the outer diameter D3 of the first screw section 19. The dimensional relationships thus explained make it possible to ensure a sufficient area of the base section 11 in order to place the string replacement assistance apparatus 10 on the guitar body 52, and to lower the center of gravity of the string replacement assistance apparatus 10. The string replacement assistance apparatus 10 can, therefore, stably stand on the guitar body 52 by itself.

When the strings 55 of the electric guitar 51 are to be replaced, the string replacement assistance apparatus 10 of the first embodiment is utilized in the manner as described below.

Figure 9:
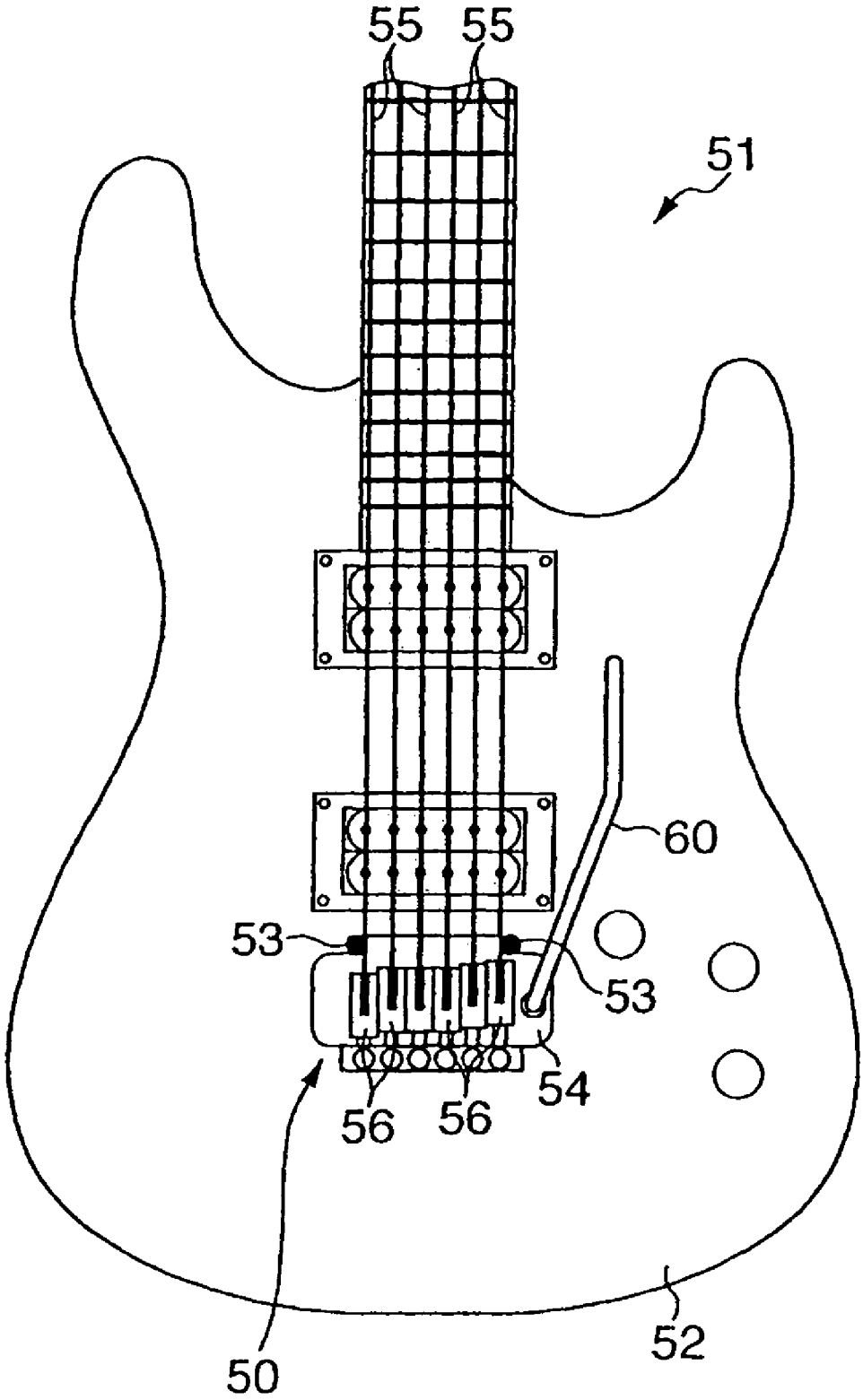
FIG. 9 is a plan view showing an electric guitar.
Figure 10:
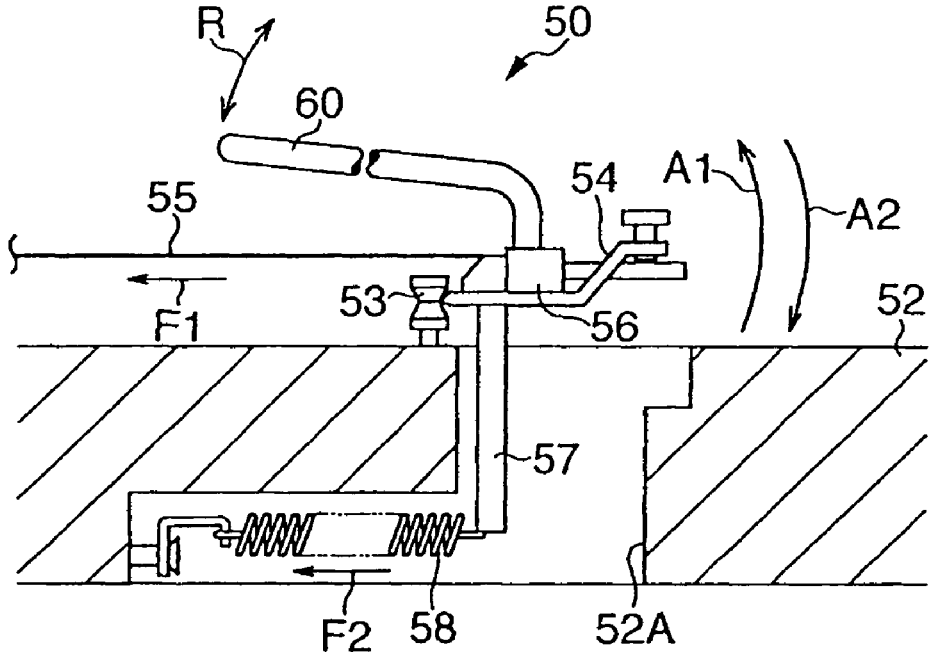
FIG. 10 is a cross-sectional view showing a conventional tremolo unit.

The electric guitar 51 is initially in a state shown in FIG. 9 in which the strings 55 are attached with respective tension to the electric guitar 51 and the tremolo arm 60 is in a musical performance position. When the strings 55 are to be replaced, a free end of the tremolo arm 60 is rotated, first, in a clockwise direction about 180° to be positioned below the tremolo unit 50 in FIG. 9. Then, as shown in FIG. 1, the tremolo arm 60 is inserted in the opening 16 of the holding section 12 and, thereafter, the string replacement assistance apparatus 10 is put on the guitar body 52 with the base section 11 contacted to the body 52. In a case in which the distance H1 (see FIG. 3) between the tremolo arm 60 and the guitar body 52 is different from a distance H2 between the lower inner wall of the opening 16 and the lower surface of the base section 11, the length of the connecting section 13 is adjusted by tightening or loosing the first and second screw portions 19 and 20 relatively to each other to make the distance H1 and the distance H2 be substantially equal. In this state, the string replacement assistance apparatus 10 temporally holds the tremolo arm 60 in the position shown in FIG. 1 relative to the guitar body 52 in which the holding section 12 holds the tremolo arm 60 in the opening 16 while the base section 11 is set on the guitar body 52 with the friction caused by the friction member 15.

Figure 11:
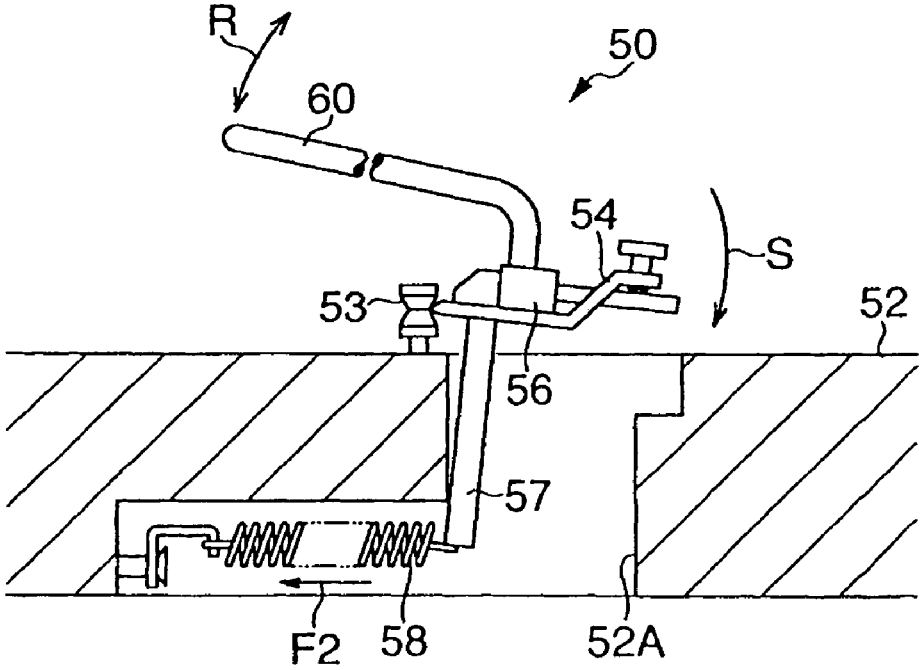
FIG. 11 is a cross-sectional view showing the conventional tremolo unit shown in FIG. 10 in a state that strings are removed from the tremolo unit.

Next, the strings 55 are removed from the tremolo unit 50 of the electric guitar 51 in the manner known in the art. Since the tension of the strings 55 exerted to the tremolo unit 50 is diminished, the spring force F2 of the tension spring 58 tends to cause the bridge base 54 of the tremolo unit 50 to incline in the direction indicated by arrow S as shown in FIG. 11 and as previously described. Owing to the string replacement assistance apparatus 10, however, the angular position of the tremolo arm 60 is fixed so as to prevent the bridge base 54 from inclining to the direction S. The bridge base 54 is, therefore, also fixed in pivotal position relative to the guitar body 52. In this state of the bridge base 54, new strings 55 are attached to the tremolo unit 50 at their one ends and wound up to the turning screws located at the head of the electric guitar 51 at their other ends. The replacement of the strings is thus completed.

As described above, according to the first embodiment of the present invention, the string replacement assistance apparatus 10 can fix the relative positions between the guitar body 52 and the tremolo unit 50 when the strings 55 are replaced. The tremolo unit 50 can thus be maintained at the same position as when the strings are attached with respective tension to the tremolo unit 50 even when the strings 55 are removed from the tremolo unit 50. The amount of string wound around the turning screw at the head, i.e., the wound number required to apply a suitable tension to the string, can thus be reduced. Accordingly, it is possible to facilitate the operation for the replacement of the strings and to reduce the period of time required to the string replacement operation.

Further, the outer diameters D2 and D1 of the base section 11 and the holding section 12 are determined as described above. For this reason, the angular and rotational position of the tremolo arm 60 is stably maintained by the holding section 12 of the string replacement assistance apparatus 10 which can stand on the guitar body 52 by itself in the state where the holding section 12 is located at upper portion with respect to the base section 11 via the connecting section 13.

Second Embodiment

Next, a second embodiment of the present invention will be explained. Structural elements similar to or the same as the first embodiment bear the same reference numerals and explanations thereof are omitted.

Figure 5:
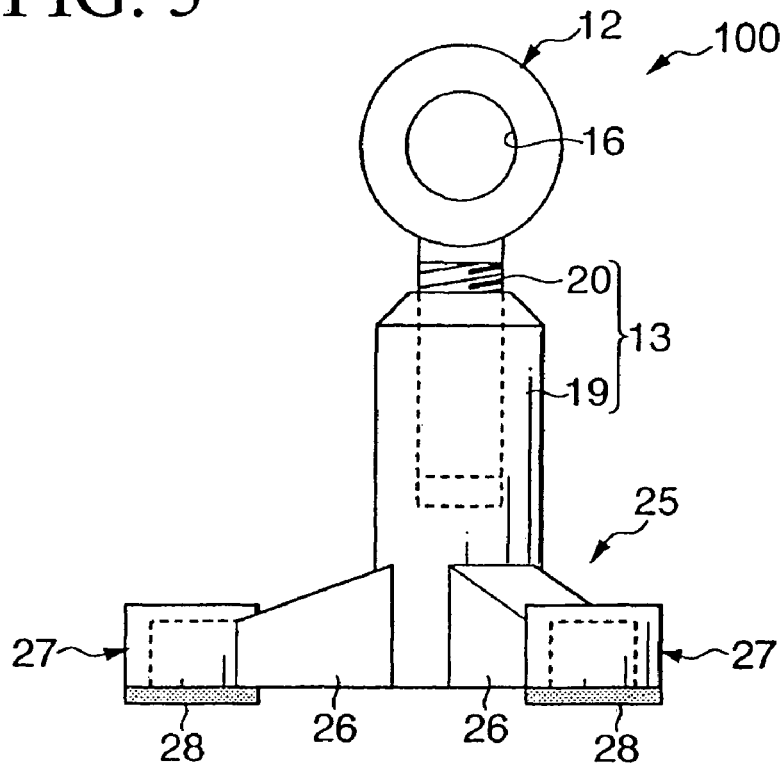
FIG. 5 is a front view showing a string replacement assistance apparatus according to a second embodiment of the present invention.
Figure 6:
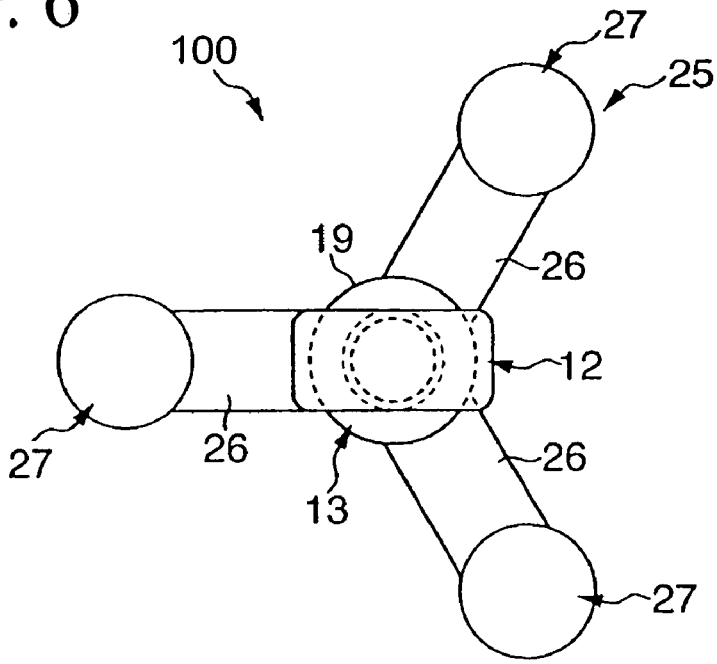
FIG. 6 is a plan view showing the string replacement assistance apparatus according to the second embodiment of the present invention shown in FIG. 5.

FIGS. 5 and 6 show a string replacement assistance apparatus according to a second embodiment of the present invention. The string replacement assistance apparatus 100 according to the second embodiment differs from that of the first embodiment in a configuration of a base section.

The string replacement assistance apparatus 100 has a base section 25 which consists of three leg portions 26 integrally formed with a first screw portion 19 of a connecting section 13 and three cylindrical end portions 27 provided on outer peripheral ends of the leg portions 2, respectively. The leg portions 26 are extended from and toward the outer periphery of the connecting section 13 and arranged at an angle of 120° from each other around the connecting section 13. The base section 25 thus dispersedly contacts with the guitar body 52 at the three end portions 27. Each of the end portions 27 is attached with a friction member 28 at its lower surface facing the guitar body 52. The material of the friction member 28 is similar to that of the friction member 15 in the first embodiment.

The string replacement assistance apparatus 100 according to the second embodiment is used in the manner similar to the first embodiment and has advantages similar to the first embodiment. Further, even if the upper or front surface of the body 52 of the electric guitar 51 or a stringed instrument has curved shape, the base section 25 functions like a tripod owing to the three leg portions 26 and the three end portions 27 to stably hold the string replacement assistance apparatus 100 in the standing state on the body 52. This structure makes it possible to stably hold the tremolo arm 60 in the arm-up position.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

Therefore, the above description made for the configuration of the various parts is exemplary to facilitate to understanding of the present invention. Various parts not having such configuration may be included in the scope of the present invention.

Figure 7A:
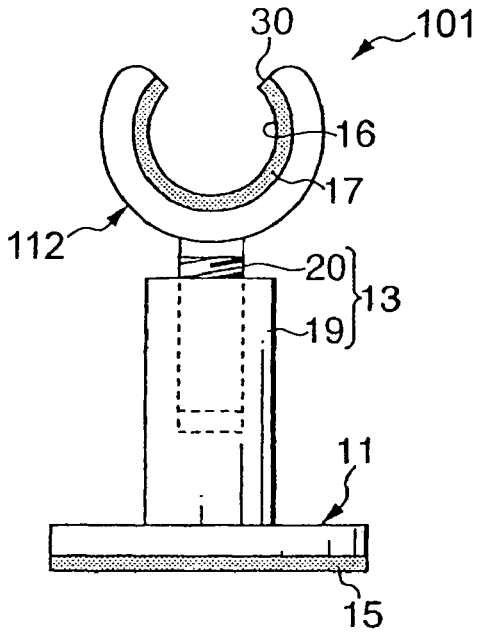
FIGS. 7A and 7B are front views showing an alternative structure of the string replacement assistance apparatus according to the first embodiments of the present invention.
Figure 7B:
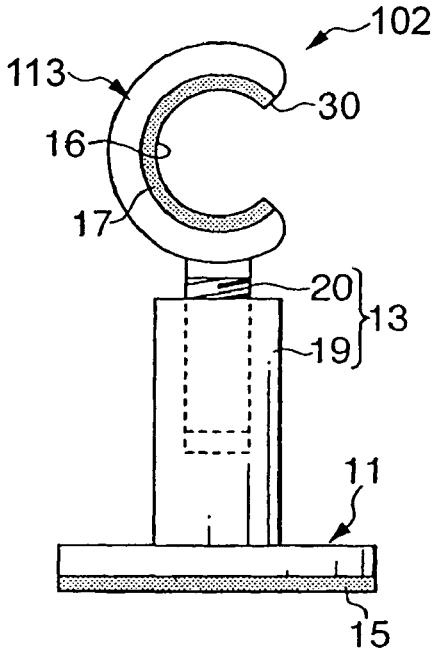

For instance, the design of the holding section 12 may be changed as long as it has a function capable of holding the tremolo arm 60. FIGS. 7A and 7B show such an alternative design. In FIG. 7A, a holding section 112 of a string replacement assistance apparatuses 101 has a notch 30 to allow to pass the tremolo arm 60 at its upper portion and has a U-shaped configuration. In FIG. 7B, a holding section 113 of a string replacement assistance apparatuses 102 also has a notch 30 to allow to pass the tremolo arm 60 at its side portion and has a C-shaped configuration. According to those structures, the longitudinally middle portion of the tremolo arm 60 can pass through the notch 30 of the holding sections 112 or 113 after the string replacement assistance apparatus 101 or 102 is put on the body of the stringed instrument so that the tremolo arm 60 can be held by the openings 16 of the holding sections 112 and 113. When passing the tremolo arm 60 through the notch 30, the position of the openings 16 can be adjusted by rotating the holding sections 112 and 113 by means of the first and second screw portions 19 and 20 in order to facilitate the insertion of the tremolo arm 60 to the openings 16.

Figure 8:
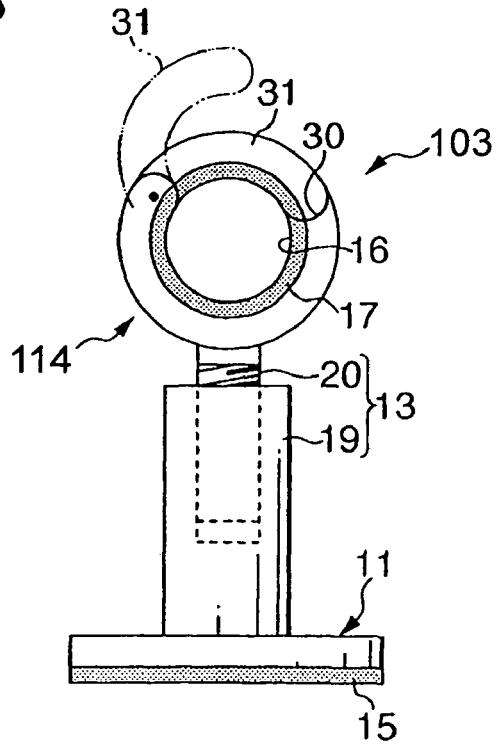
FIG. 8 is a front view showing another alternative structure of the string replacement assistance apparatus according to the first embodiments of the present invention.

Further, as shown in FIG. 8, a holding section 114 of a string replacement assistance apparatus 103 has a movable lever 31 for opening and closing the notch 30. The tremolo arm 60 can be passed through the notch 30 when the movable lever 31 is opened. After the tremolo arm 60 is received by the opening 16, the movable lever 31 is closed.

Furthermore, the configuration of the base section 11 of the first embodiment may be oval, rectangular or polygonal. The base section 25 of the second embodiment may have more than three leg portions and end portions to increase the contacting portion to the body 52 and the stability of the string replacement assistance apparatus.

Furthermore, in the connecting section 13, the first screw portion 19 may have a male screw while the second screw portion 20 may have a female screw.

As described above, according to the present invention, the string replacement assistance apparatus can fix the relative position between the stringed instrument body and the tremolo unit when the strings are replaced. The tremolo unit can thus be maintained at the same position as when the strings are attached with respective tension to the tremolo unit even when the strings are removed from the tremolo unit. The amount of string wound around the turning screw at the head, i.e., the wound number required to apply an appropriate tension to the string, can thus be reduced. Accordingly, it is possible to facilitate the operation for the replacement of the strings and to reduce the period of time required to the string replacement operation.

According to one aspect of the present invention described above, the height or the distance between the base section and the holding section can be adjusted. The position of the holding section can thus be adjusted to meet the distance between the body of the stringed instrument and the tremolo arm to surely hold the tremolo arm. The position of the holding section can accordingly be suitably adjusted according to the shape of any tremolo arm. The string replacement assistance apparatus can be used for various kinds of the stringed instruments having various shapes of tremolo arms, accordingly.

According to another aspect of the present invention, the direction of the opening of the holding section for holding the tremolo arm can be adjusted. After putting the string replacement assistance apparatus on the body of the stringed instrument, the opening of the holding section can be placed at a position to easily receive the tremolo arm. It makes the operation of holding the tremolo arm easy and accurate.

According to still another aspect of the present invention, the base section has the flexible friction member. This structure prevents the string replacement assistance apparatus from unexpectedly sliding on the body of the stringed instrument while the strings are replaced. Thus, it can reduce the accident that the body of the stringed instrument is damaged by the unexpected movement of the string replacement assistance apparatus.

According to still another aspect of the present invention, the base section has a plurality of leg portions and end portions which separately contact the body of the stringed instrument. Owing to this structure, the string replacement assistance apparatus can stably hold the angular and rotational position of the tremolo arm by the holding section.

What is claimed is:

1. A string replacement assistance apparatus for a stringed instrument equipped with a tremolo unit on a body of said stringed instrument, said tremolo unit having a pivotal movement in arm-up and arm-down directions by operation of a tremolo arm connected thereto, comprising:

a base section for being temporarily set on a top surface of said body of said stringed instrument and provided with a friction member on a bottom surface of said base facing said body of said stringed instrument, a surface of said friction member being in contact with said top surface of said body of said stringed instrument; and a holding section which is elongated from said base section to hold said tremolo arm; and wherein:

said string replacement assistance apparatus has a height equal to a distance between said top surface and said tremolo arm in a non-operational position; and said string replacement assistance apparatus is temporarily set on said top surface of said body of said stringed instrument to hold said tremolo arm while in a position facing towards a rear of said body to prevent said tremolo unit from pivotal movement in a arm-down direction when strings for said stringed instrument are replaced.

2. A string replacement assistance apparatus as recited in claim 1, wherein a distance between said base section and said holding section is adjustable.

3. The string replacement assistance apparatus according to claim 2, wherein said holding section is coupled to said base section by a cylindrical connecting section and a female screw portion is provided in said cylindrical connecting section and said holding section is further provided with a male screw portion which is screwed into said female screw portion.

4. A string replacement assistance apparatus as recited in claim 1, wherein said holding section has an opening to receive said tremolo arm, said opening being capable of turning its direction.

5. A string replacement assistance apparatus as recited in claim 1, wherein said base section includes a plurality of contact portions for engagement with said surface of said body of said stringed instrument.

6. A string replacement assistance apparatus as recited in claim 1, wherein said holding section prevents said pivotal motion of said tremolo unit by holding said tremolo arm when said strings are replaced.

7. A string replacement assistance apparatus as recited in claim 1, wherein said holding section holds a pivotal position of said tremolo unit when said strings are attached to said stringed instrument by holding said tremolo arm when said strings are replaced.

8. The string replacement assistance apparatus according to claim 1, wherein said base section is provided with a plurality of outwardly extending leg portions which arc for engagement with said top surface of said body and said friction member comprises a plurality of friction members wherein one of said plurality of friction members is provided on a bottom surface of one end of each of said plurality of leg portions.

9. The string replacement assistance apparatus according to claim 1, wherein said holding section comprises a circular ring.

10. The string replacement assistance apparatus according to claim 9, wherein said circular ring includes a notch and a movable lever for opening and closing said notch, whereby insertion of said tremolo arm in said holding section is facilitated.

11. The string replacement assistance apparatus according to claim 1, wherein said holding section comprises a C-shape member which is rotatably mounted on said base section such that C-shaped section is rotatable from a position wherein a notch in said C-shape member faces upwardly to a position wherein the notch is facing horizontally to hold said tremolo arm.

12. The string replacement assistance apparatus according to claim 1, wherein said friction member is a rubber plate.

13. A string replacement assistance apparatus as recited in claim 1, wherein said holding section is elongated from said base section by said height to hold the distance between said top surface and said tremolo arm substantially constant so as to maintain said tremolo unit at substantially the same position either when said strings are attached to or removed from said tremolo unit.

* * * * *